United States Patent [19]

Dines

[11] 4,071,096

[45] Jan. 31, 1978

[54] SHAPED CHARGE WELL PERFORATING APPARATUS

[75] Inventor: Jack E. Dines, Fort Worth, Tex.

[73] Assignee: Jet Research Center, Inc., Arlington, Tex.

[21] Appl. No.: 758,299

[22] Filed: Jan. 10, 1977

[51] Int. Cl.[2] ..... E21B 7/00

[52] U.S. Cl. ..... 175/4.6; 166/63; 102/21.6

[58] Field of Search ..... 102/201, 21.6; 175/4.59, 4.51, 4.6, 4.57, 4.58; 166/299, 63

[56] References Cited

U.S. PATENT DOCUMENTS

| | | | |
|---|---|---|---|
| 3,011,550 | 12/1961 | Kenneday | 175/4.51 |
| 3,175,617 | 3/1965 | North | 166/63 X |
| 3,242,987 | 3/1966 | Lebourg | 166/299 X |
| 3,346,057 | 10/1967 | Bell | 175/4.6 X |
| 3,429,384 | 2/1969 | Shore | 175/4.6 |
| 3,874,461 | 4/1975 | Concanower | 175/4.6 |

FOREIGN PATENT DOCUMENTS

| | | | |
|---|---|---|---|
| 262,192 | 6/1968 | Austria | 175/4.6 |

*Primary Examiner*—Ernest R. Purser
*Assistant Examiner*—Richard E. Favreau
*Attorney, Agent, or Firm*—Thomas R. Weaver; C. Clark Dougherty, Jr.; John H. Tregoning

[57] ABSTRACT

Apparatus for perforating a well comprised of a closed retrievable carrier formed in an elliptic cylindrical shape and having shaped charge perforating means disposed therein. Upon actuation of the shaped charge perforating means the ellipticity of the carrier is reduced.

15 Claims, 11 Drawing Figures

SHAPED CHARGE WELL PERFORATING APPARATUS

In the completion of oil and gas wells, the well bore is usually cased and one or more small diameter tubing strings are extended within the well bore to producing zones therein. When two or more producing zones are completed in a single well, packers are set above each of the producing zones and small diameter tubing strings are placed in the well bore which communicate the packed off zones with the surface. In perforating such well bores, a perforating apparatus is lowered through the small diameter tubing string to the zone to be perforated, the apparatus is positioned and then the apparatus is actuated to form perforations through the casing and cement into the producing zone whereby communication is established between the zone and the tubing string.

In recent years, shaped charge perforating apparatus of the retrievable type have been developed and used. These apparatus generally include an array of shaped charges disposed within an enclosed carrier which, upon detonation of the shaped charges, remains relatively intact so that it can be retrieved, and the debris produced as a result of the explosion of the shaped charges is contained within the carrier. In such retrievable perforating apparatus, the wall of the enclosed carrier is penetrated immediately in front of each shaped charge by the hot stream of high pressure gases and high velocity particles or "jet" produced by the explosion, and an outward protrusion of metal or "burr" is formed at each perforation. Also, the explosive forces exerted within the carrier cause the carrier to swell or bulge in the vicinity of each shaped charge. The swelling of the carrier and the formation of burrs thereon have heretofore made it necessary that the carrier be of significantly smaller diameter than the small diameter tubing through which it must be retrieved in order to prevent the carrier from becoming stuck in the tubing string.

Since one very important factor in the penetrating capability of shaped charges is the "stand-off" distance utilized, i.e., the distance that the jets formed by the detonation of the shaped charges can travel before meeting an obstruction, it has been the practice heretofore to utilize carriers which are designed so that the burrs produced are substantially confined to within the diameter of the carrier thereby allowing the carrier to be of a size more closely approaching the size of the tubing through which it must be retrieved. The confining of the burrs to within the diameter of the carrier has generally been accomplished by forming recesses in the outer wall of the carrier immediately in front of each shaped charge so that upon detonation of the shaped charges the resulting jets pass through the carrier walls at areas of reduced wall thickness formed by the recesses. In this manner, the burrs produced, or at least substantial portions of the burrs, remain within the circumferential bounds defined by the external diameter of the carrier. However, as is well understood by those skilled in the art, even where the largest possible size of shaped charge is used in a tubular carrier of circular shape in cross section, and the carrier is of the largest possible size which can be retrieved after swelling through a given size of tubing string, the resultant stand-off distance is well below the optimum, and less than the optimum penetration is achieved.

By the present invention, an improved well perforating apparatus of the retrievable enclosed carrier type is provided which for a given tubing string size can include a carrier providing an increased shaped charge stand-off distance and superior operating characteristics as compared to prior carriers while still allowing the expended carrier to be retrieved through the tubing string, or the apparatus of the present invention can include a carrier providing the same stand-off distance as prior carriers which can be much more readily retrieved through the tubing string.

The shaped charge well perforating apparatus of the present invention includes a closed tubular carrier adapted to be lowered and raised through tubing in a well bore. At least a portion of the carrier is formed in an elliptic cylindrical shape and a shaped charge perforating means is disposed therein. The perforating axis of the shaped charge means is positioned coincidentally with the long axis of the ellipse defined by the wall of the elliptic cylindrical portion of the carrier when viewed in transverse cross section. Upon detonation of the shaped charge means and penetration of the carrier wall by the jets formed thereby, the ellipticity of the elliptic cylindrical portion of the carrier is reduced whereby the swelling of the wall thereof and the formation of burrs thereon do not prevent said carrier from being retrieved through said tubing.

In the accompanying drawings forming a part of this disclosure:

Figure 4:
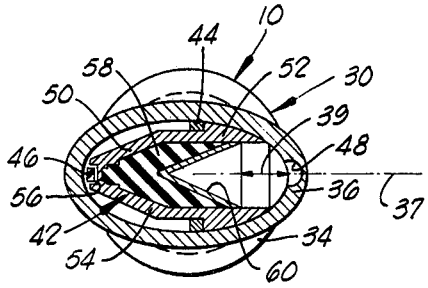
Figure 5:
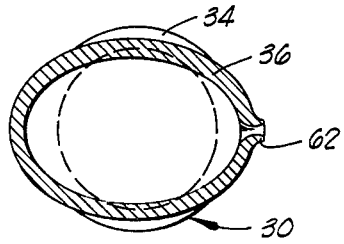
Figure 3A:
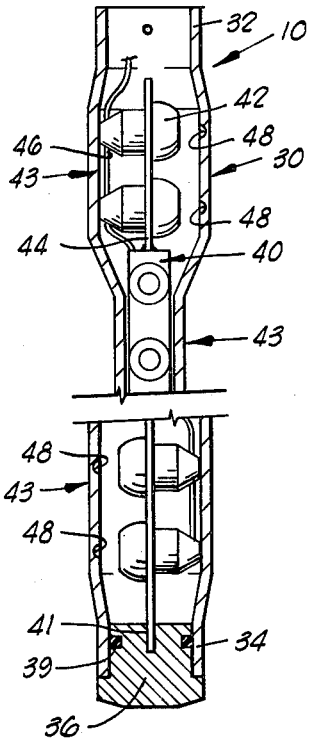
FIG. 3 is an elevational cross sectional view taken along line 3—3 of FIG. 2.
Figure 3:
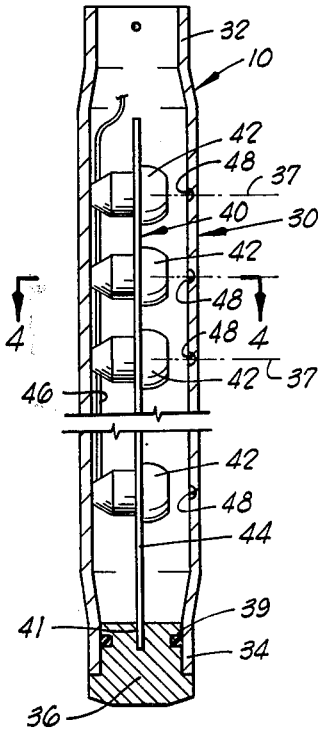
Figure 5:
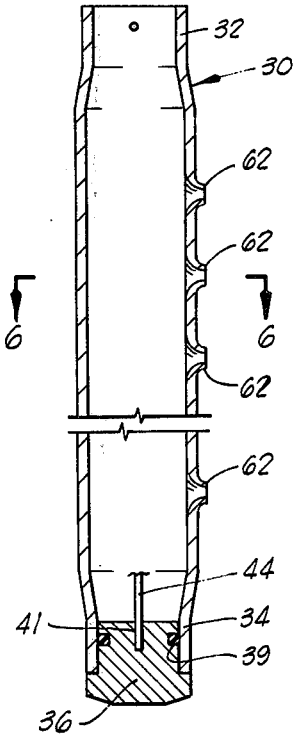
Figure 7:
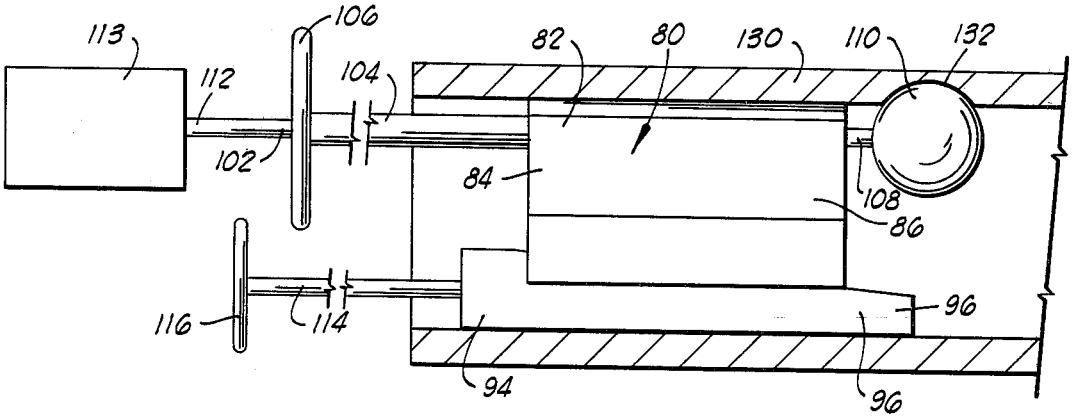
Figure 8:
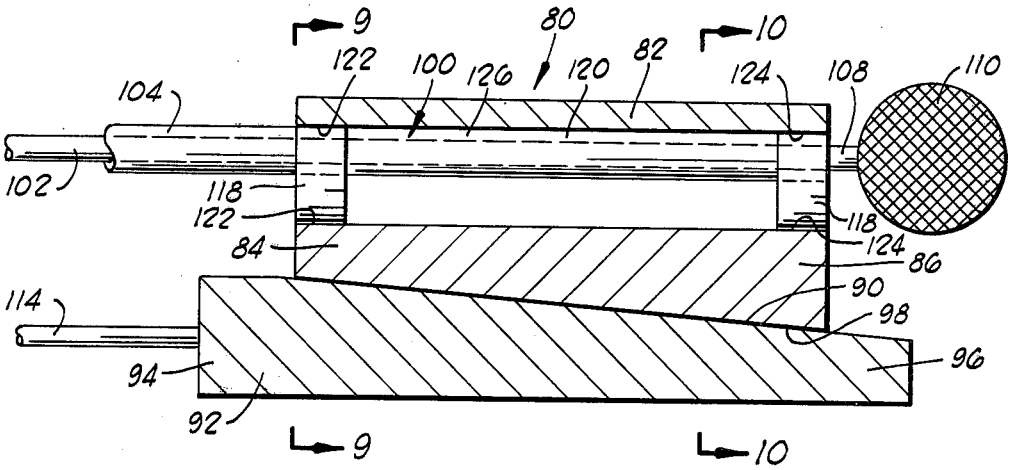
Figure 9:
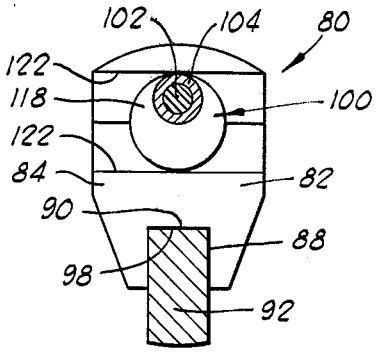
Figure 10:
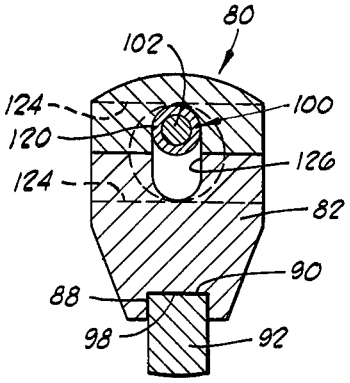

FIG. 3*a* is an elevational view of an alternate embodiment of the perforating apparatus of the present invention;

FIG. 4 is a transverse cross sectional view taken along line 4—4 of FIG. 3;

FIG. 5 is an elevational cross sectional view similar to FIG. 3, but illustrating the apparatus as it generally appears after detonation of the shaped charges contained therein;

FIG. 6 is a transverse cross sectional view taken along line 6—6 of FIG. 5;

FIG. 7 is a side elevational view of one form of apparatus for forming internal recesses in the carrier of the present invention;

FIG. 8 is a side elevational view of the apparatus of FIG. 7 taken partially in cross section;

FIG. 9 is a cross sectional view taken along line 9—9 of FIG. 8; and FIG. 10 is a cross sectional view taken along line 10—10 of FIG. 8.

Figure 1:
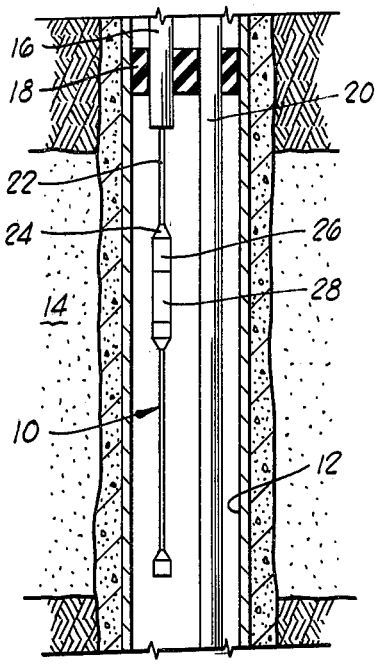
FIG. 1 illustrates a dually completed well bore having the well bore perforating apparatus of the present invention positioned therein.

Referring now to the drawings, and particularly to FIGS. 1–4, the apparatus of the present invention is illustrated and generally designated by the numeral 10. Referring specifically to FIG. 1, the perforating apparatus 10 is illustrated positioned in a typical cased and cemented well bore 12 adjacent a subterranean producing zone 14. The well bore 12 is illustrated after being completed in a manner whereby two producing zones can be simultaneously or separately produced. However, as will be understood, the well bore 12 can contain a single string of tubing communicating with a single producing zone or more than two strings of tubing communicating with three or more producing zones. In the dually completed well bore illustrated, a small diameter string of tubing 16 is suspended in the well bore 12 which extends through a conventional packer 18. A second string of tubing 20 suspended in the well bore 12 extends through the packer 18 and through a second packer (not shown) below the formation 14 into a lower producing zone (not shown). The two producing zones are isolated by the packers and are each communicated with the surface by the strings of tubing 18 and 20.

In perforating the producing zone 14, the perforating apparatus 10 is lowered through the tubing string 16 by means of a cable 22 connected to a cable head 24. The cable head 24 is connected to a conventional collar locator 26 which is in turn connected to a conventional positioning device 28. The apparatus 10 is connected to the positioning device 28. The collar locator 26 is utilized for determining the depth of the perforating apparatus 10, and the positioning device 28 is utilized for insuring that the apparatus 10 is properly positioned within the well bore 12 prior to actuation. After actuation of the apparatus 10 and the production of perforations through the casing and cement in the well bore 12 into the producing zone 14, the apparatus 10 is retrieved by raising it back through the tubing string 16. A variety of depth indicating and positioning devices can be utilized with the apparatus 10 which are well known, and consequently, such devices will not be discussed in detail herein.

Figure 2:
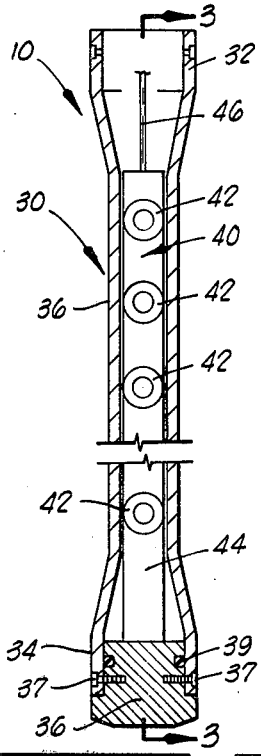
FIG. 2 is an elevational view of the perforating apparatus of FIG. 1 taken in cross section.

Referring now specifically to FIGS. 2–4, the apparatus 10 is illustrated prior to the actuation thereof, i.e., prior to the detonation of the shaped charges disposed therein. The apparatus 10 is comprised of a tubular carrier 30 which in a preferred form has a circular cylindrical upper end portion 32, a circular cylindrical lower end portion 34 and an elliptic cylindrical portion 36 between the end portions 32 and 34. The upper end portion 32 is adapted to receive a female member (not shown) which sealingly connects the carrier 30 to the positioning device 28, and the lower end portion 34 is adapted to receive a female plug 36 which is held in place by a plurality of cap screws 37 extending through the wall of the end portion 34. One or more conventional O-Rings 39 are utilized in the usual manner for providing a pressure seal between the plug 36 and the internal wall surfaces of the end portion 34.

Disposed within the elliptic cylindrical portion 36 of the carrier 30 is a shaped charge perforating means generally designated by the numeral 40. The perforating means 40 is comprised of a plurality of shaped charges 42 arranged in a vertical array by means of a charge holder or rack 44. The rack 44 can take a variety of forms, but generally is comprised of a flat plate having a plurality of openings disposed therein for receiving the shaped charges 42 and maintaining them in a vertical array as illustrated in FIGS. 2 and 3. The rack 44 is held within the carrier 30 in a fixed position by means of a special slot 41 disposed in the plug 36. In the embodiment illustrated in FIGS. 2–4, the shaped charges 42 are positioned with the perforating axes thereof, i.e., the axes of the jets formed upon detonation of the shaped charges, positioned parallel to each other and transverse to the longitudinal axis of the carrier 30. As will be understood, all of the shaped charges 42 can be faced in the same direction as shown in FIGS. 2–4 so that upon detonation perforations are produced in a single direction relative to the apparatus 10, or if desired, some of the shaped charges 42 can be positioned facing in the opposite direction from the other charges 42 whereby upon detonation perforations are simultaneously produced in opposite directions. The shaped charges 42 are interconnected for detonation by an igniting means 46 as, for example, a detonating cord coupled to a conventional blasting cap or other detonator (not shown). The blasting cap or other detonator is in turn electrically connected by way of the cable 22 to a suitable power source at the surface.

In a preferred form of the invention, the carrier 30 includes a plurality of longitudinally spaced recesses 48 disposed in the internal surface of the elliptic cylindrical portion 36. Each of the recesses 48 is positioned adjacent a shaped charge 42 so that the perforating axes of the shaped charges 42 intersect the recesses 48. That is, the recesses 48 form areas of reduced wall thickness which lie directly in the path of the jets produced by the shaped charges upon detonation.

As best shown in FIG. 4, each of the shaped charges 42 is comprised of an elongated hollow container 50 having a forward portion 52 which is suitably curved so as to conform to the elliptical shape of the portion 36 of the carrier 30, and a generally frusto-conical rearward portion 54 which tapers inwardly and includes a recess 56 at its rearward extremity for receiving the detonating cord 46. The container 50 is substantially filled with an explosive material 58 which is maintained within the container 50 by a conically-shaped liner 60. The particular type of explosive material 58 and the amount thereof used in each of the shaped charges 42 as well as the size and shape of the liner 60 vary depending upon a variety of factors well known to those skilled in the art. Generally, the conical shape of the liner 50 and its relationship to the explosive material 58 produce a successive collapse of the liner upon detonation of the explosive material progressing toward and along the axis of the liner, i.e., the perforation axis. Consequently, the explosion produces a relatively high velocity elongated jet capable of making holes with deep penetration in single direction.

As mentioned above, and as is also well known by those skilled in the art, the distance that the jet produced by a shaped charge can travel as it is being formed before meeting an obstruction significantly affects the depth to which the jet will penetrate a given target. Thus, even a slight increase in the stand-off distance 39 between the forward ends of the liners 60 of the shaped charges 42 and the interior wall surface of the carrier 30 results in a significant increase in the performance of the perforating apparatus 10, i.e., an increase in the depth of perforations produced. In accordance with the present invention, the shaped charges 42 are positioned within the elliptic cylindrical portion 36 of the carrier 30 with the perforating axes 37 of the shaped charges coinciding with the long axis of the ellipse formed by the wall of the elliptic cylindrical portion 36 when viewed in transverse cross section as shown in FIG. 4. As will be discussed in greater detail hereinbelow, because the ellipticity, i.e., the degree of divergence of an ellipse from a circle, of the elliptic cylindrical portion 36 of the carrier 30 is reduced by the explosive forces produced within the carrier 30 upon detonation of the shaped charges 42, the effective size of the carrier 30 (without the recesses 48) for a given size tubing string can be greater than heretofore used carriers, i.e., the stand-off distance 39 for the same size of shaped charge is greater, or alternatively, if the carrier 30 is of the same effective size as heretofore used carriers, the carrier 30 achieves a smaller overall size after detonation of the shaped charges making it significantly more readily retrieved. In addition to the increased stand-off provided by the elliptic cylindrical shape of the portion 36 of the carrier 30, the internal recesses 48 disposed in the interior wall surface of the elliptic cylindrical portion 36 provide additional stand-off, all of which results in a significant increase in the depth of perforations produced by the apparatus 10 as compared to heretofore used perforating apparatus.

Referring now to FIGS. 5 and 6, the apparatus 10 is illustrated after the operation thereof, i.e., after the detonation of the shaped charges 42 and the production of perforations in a well bore thereby. As stated above, the jets formed by the detonation of the shaped charges 42 penetrate the wall of the carrier 30 in the areas of relative thinness formed by the recesses 48 and produce burrs 62 extending outwardly thereon. Simultaneously, and because of the explosive forces acting on the internal wall surfaces of the carrier 30, the ellipticity of the elliptic cylindrical portion 36 thereof is reduced. That is, the long axis of the ellipse defined by the wall of the elliptic cylindrical portion when viewed in transverse cross section changes in length only slightly with the short axis of such ellipse being appreciably lengthened as compared thereto. Thus, the enlargement of the elliptic cylindrical portion of the carrier 30 primarily takes place in directions coincident or parallel with the short axis of the ellipse whereby the overall size of the carrier 30 including burrs is substantially still confined to an area within or only slightly larger than the largest dimension of the carrier 30 prior to the detonation of the shaped charges 42 when viewed in transverse cross section.

The carrier 30 can include a single continuous elliptic cylindrical portion 36 as illustrated in FIGS. 2–4, or the individual portions of the carrier 30 surrounding each of the shaped charges 42 can be of elliptic cylindrical shape with the portions therebetween being of circular cylindrical shape. In the latter arrangement as illustrated in FIG. 3*a*, the perforation axes of the shaped charges 42 and the coinciding axes of the related elliptic cylindrical portions 43 can be positioned in different vertical planes intersecting the longitudinal axis of the carrier 30 so that perforations are simultaneously produced by the apparatus 10 in a plurality of directions relative to the apparatus 10. In all of the various arrangements possible, the critical dimension of the apparatus 10 is the length of the long axis or axes of the elliptic cylindrical portion or portions defined by the external wall surfaces thereof when viewed in transverse cross section prior to detonation of the shaped charges 42. This is so because as described above after detonation of the charges 42, the ellipticity of the elliptic cylindrical portion or portions of the carrier 30 are reduced and the largest dimension of the carrier 30 after detonation is at worst only a small amount greater than the critical dimension prior to detonation. In the case of the heretofore used entirely circular cylindrical carriers, the critical dimension is the largest transverse cross sectional dimension after detonation which is subject to variation and thereby creates greater possibility that problems will be encountered in retrieving the apparatus from the well bore.

Thus, after actuation of the apparatus 10 and the perforation of the well bore in which the apparatus 10 is positioned, the carrier 30 remains substantially intact and contains the debris (not shown) produced by the explosion of the shaped charges. More importantly, the deformation of the carrier 30 as a result of the internal explosive forces acting on it is such that the carrier 30 can be readily retrieved through the tubing string disposed in the well bore. As stated, the effective size of the carrier 30 can be greater for a given tubing size than prior circular cylindrical carriers thereby significantly increasing the shaped charge stand-off and the depth to which the perforating jets produced by the shaped charges penetrate a given target. For example, tests conducted in accordance with the American Petroleum Institute *Recommended Practice Standard Procedure for Evaluation of Well Perforators,* API RP-43, Second Edition, November, 1971, illustrate that with all variables being equal the apparatus of the present invention with internal recesses 48 produces deeper perforations than a comparable carrier entirely of circular cylindrical shape as follows:

EXAMPLE

Carriers of the present invention of elliptic cylindrical shape sized to be retrieved through tubing having an internal diameter of 1.78 inches (the long axis of the ellipse defined by the external wall surfaces is 1.69 inches long and the short axis is 1.42 inches long) and containing a shaped charge of the type described above are tested in accordance with API RP-43 procedure with the results shown in Table I below.

TABLE I

| | ELLIPTIC CYLINDRICAL CARRIER | | | |
|---|---|---|---|---|
| Test | Entrance Hole Diameter, Inches | Core Target | Distance Between Outer Surface of Carrier and Target (Clearance) | Total Target Penetration (TTP), Inches |
| 1 | 0.29 | BEREA | 0 | 5.75 |
| 2 | 0.28 | BEREA | 0 | 5.70 |
| 3 | 0.30 | BEREA | 0 | 5.42 |
| 4 | 0.30 | BEREA | 0 | 5.70 |
| 5 | 0.30 | BEREA | 0 | 6.11 |
| Average of Tests 1–5: | 0.29 | | | 5.74 |

In each of Tests 1–5 the deformed elliptical carrier after detonation passes through tubing of 1.78 inches internal diameter. Circular cylindrical carriers sized to be retrieved through tubing having an internal diameter of 1.78 inches (the outer diameter of each carrier is 1.56 inches), having the same wall thickness and containing the same shaped charge as the above-described elliptical carriers are tested in accordance with API RP-43 procedure with the results shown in Table II below.

TABLE II

| Test | Entrance Hole Diameter, Inches | Core Target | Distance Between Outer Surface of Carrier and Target (Clearance) | Total Target Penetration (TTP), Inches |
|---|---|---|---|---|
| | CIRCULAR CYLINDRICAL CARRIER | | | |
| 1 | 0.29 | BEREA | 0 | 5.32 |
| 2 | 0.33 | BEREA | 0 | 5.32 |
| 3 | 0.30 | BEREA | 0 | 5.28 |
| 4 | 0.28 | BEREA | 0 | 6.02 |
| 5 | 0.27 | BEREA | 0 | 3.35 |
| Average of Tests 1–5: | 0.27 | | | 5.06 |

In each of Tests 1–5 the deformed circular carrier after detonation passes through tubing of 1.78 inches internal diameter.

As shown in Tables I and II above, perforation apparatus having an elliptic cylindrical carrier achieves a greater penetration than does comparable apparatus having a circular carrier. More specifically, the apparatus of the present invention without an internal recess produces an average depth for five test shots of 5.74 inches while the circular carrier perforator produces an average depth for five test shots of 5.06 inches, a difference of 13.4 percent.

The recesses 48 can be formed in the internal wall surface of the elliptic cylindrical portion 36 of the carrier 30 using various methods and apparatus. One method, by way of example, is to mill the recesses in the internal wall surfaces of the carrier after one or more elliptic cylindrical portions are formed therein with the long axes of the ellipses formed by the walls of the elliptic cylindrical portions intersecting the recesses. Referring to FIGS. 7–10, one form of milling apparatus which can be utilized for milling the recesses is illustrated and generally designated by the numeral 80.

The apparatus 80 is comprised of a housing 82 having a forward end 84 and a rearward end 86. A rectangular shaped recess 88 is provided in a lower surface of the housing 82 having a downwardly facing flat surface 90 which slopes downwardly from the forward end 84 to the rearward end 86 of the housing 82. A wedge-shaped gib 92 having a forward end 94 and a rearward end 96 is disposed within the recess 88 of the housing 82. The gib 92 has an upwardly facing flat surface 98 which slopes downwardly from the forward end 94 to the rearward end 96 of the gib 92. As will be understood, the downwardly facing surface 90 of the housing 82 and the upwardly facing surface 98 of the gib 92 are of the same slope and slidingly engage each other.

A hollow cam member 100 which will be described in detail hereinbelow, is rotatably and movably disposed within the housing 82, and a shaft 102 is rotatably positioned within and through the hollow interior of the cam member 100. An elongated tubular member 104 is rigidly attached to the cam member 100, and as best shown in FIG. 7, the tubular member 104 terminates in a handle 106. The shaft 102 extends through the tubular member 104 and the cam member 100 with the forward end 108 of the shaft 102 terminating at a position forward of the housing 82. A spherical file or mill 110 is rigidly connected to the forward end 108 of the shaft 102. The rearward end 112 of the shaft 102 is connected to an electric motor or other source of rotary power 113 for rotating the shaft 102 and the mill 110. An elongated shaft 114 is connected to the forward end 94 of the gib 92 which terminates in a handle 116.

As shown best in FIGS. 8–10, the cam member 10 includes a pair of identically orientated circular cams 118 attached to the ends of an elongated smaller diameter tubular portion 120. At each end of the housing 82, upper and lower flat horizontal cam surfaces are provided for slidingly engaging the peripheral flat surfaces of the cams 118. That is, at the forward end 84 of the housing 82, a pair of flat horizontal opposing surfaces 122 are provided for sliding engagement with the forward cam 118. At the rearward end 86 of the housing 82, a pair of flat horizontal opposing cam surfaces 124 are provided for sliding engagement with the rearward cam 118. The central small diameter portion 120 of the cam member 100 is disposed within a slot 126 which extends horizontally through the housing 82. The slot 126 is of a size and is positioned such that it allows the portion 120 of the cam member 100 to rotate and to move vertically, but not to move horizontally. Thus, as the cam member 100 is rotated, the cams 118 contact the cam surfaces 122 and 124 at each end of the housing 82 and cause the central portion 120 of the cam member 100 to move from an upper position as shown in the drawings whereby the central portion 120 is positioned at the top of the slot 126 to a lower position whereby the central portion 120 is positioned at the bottom of the slot 126.

In operation of the apparatus 80, and referring specifically to FIG. 7, after a hollow circular cylindrical member 130 has been formed into the desired elliptic cylindrical shape or shapes, the apparatus 80 is positioned therewithin. With the mill 110 lowered, i.e., the central portion 120 of the cam member 100 positioned at the bottom of the slot 126 of the housing 82, the apparatus 80 is positioned within the member 130 so that the mill 100 lies adjacent a portion of the member 130 where it is desired to form a recess. The tubular member 104 attached to the cam member 100, and the shaft 114 attached to the gib 90 extend through the open end of the member 130 to the exterior thereof. The handle 106 attached to the tubular member 104 is rigidly held and the handle 116 attached to the shaft 114 is moved forward so that the gib 92 is moved forward with respect to the housing 82 thereby causing the apparatus 80 to be rigidly wedged against the inside surfaces of the member 130 and held in position. The rotary power source 113 is started so that the shaft 102 and mill 110 are rotated, and while continuously rotating the mill 110, the handle 106 is rotated so that the tubular member 104 and the cam member 100 are rotated. The rotation of the cam member 100 causes the mill 110 to be moved upwardly into contact with the internal surface of the member 130 and a recess 132 to be milled thereinto. More specifically, as the cam member 100 is rotated, the circular cams 118 thereof slidably contact the cam surfaces 122 and 124 of the housing 82 which in turn moves the central portion 120 of the cam member 100 vertically upwardly in the slot 126 of the housing 82 thereby moving the mill 110 upwardly into contact with an internal surface of the member 130. After a first recess 132 of the desired depth and position has been milled into the member 130, the handle 116 attached to the shaft 114 is moved rearwardly with respect to the handle 106 attached to the tubular member 104 thereby disengaging the apparatus 80 from the internal surfaces of the member 130 whereupon the process described above is repeated to form additional recesses within the member 130.

What is claimed is:

1. A shaped charge well perforating carrier which comprises a closed tubular housing adapted to be lowered and raised through tubing in a well bore having at least a portion thereof formed in the shape of an elliptic cylinder so that when shaped charge perforating means disposed therein are detonated, the ellipticity of said elliptic cylindrical portion is reduced.

2. The carrier of claim 1 wherein said housing is further characterized to include at least one recess disposed in the inner wall surface of said elliptic cylindrical portion thereof positioned to intersect the long axis of the ellipse defined by the wall of said elliptic cylindrical portion when viewed in transverse cross section.

3. The carrier of claim 1 which is further characterized to include shaped charge perforating means disposed within said elliptic cylindrical portion of said housing, the perforating axis of said shaped charge means being positioned coincidentally with the long axis of the ellipse defined by the wall of said elliptic cylindrical portion when viewed in transverse cross section.

4. The carrier of claim 1 wherein the end portions of said housing are of circular cylindrical shape and the portion thereof between said end portions is elliptic cylindrical in shape.

5. The carrier of claim 4 wherein said elliptic cylindrical portion of said housing includes a plurality of longitudinally spaced recesses disposed in the inner wall surface thereof, each of said recesses being positioned to intersect the long axis of the ellipse defined by the wall of said elliptic cylindrical portion when viewed in transverse cross section.

6. The carrier of claim 1 wherein the end portions of said housing are of circular cylindrical shape and alternating portions thereof between said end portions are elliptic cylindrical and circular cylindrical in shape.

7. The carrier of claim 6 wherein each of said elliptic cylindrical portions of said housing includes a recess disposed in the inner wall surface thereof positioned to intersect the long axis of the ellipse defined by the wall of said elliptic cylindrical portion when viewed in transverse cross section.

8. Apparatus for perforating a well which comprises:

a closed tubular carrier adapted to be lowered and raised in a well bore, at least a portion of said carrier being of an elliptic cylindrical shape;

shaped charge perforating means disposed within said elliptic cylindrical portion of said carrier, the perforating axis of said shaped charge means being positioned coincidentally with the long axis of the ellipse defined by the wall of said elliptic cylindrical portion when viewed in transverse cross section so that upon detonation of said shaped charge means and penetration of said wall by the jet formed thereby, the ellipticity of said elliptic cylindrical portion of said carrier is reduced.

9. The apparatus of claim 8 wherein said carrier is further characterized to include at least one recess disposed in the inner wall surface of said elliptic cylindrical portion thereof positioned to intersect the long axis of the ellipse defined by the wall of said elliptic cylindrical portion when viewed in transverse cross section.

10. The apparatus of claim 8 wherein the end portions of said carrier are of circular cylindrical shape and the portion thereof between said end portions is elliptic cylindrical in shape.

11. The apparatus of claim 10 wherein said elliptic cylindrical portion of said carrier includes a plurality of longitudinally spaced recesses disposed in the inner wall surface thereof, each of said recesses being positioned to intersect the long axis of the ellipse defined by the wall of said elliptic cylindrical portion when viewed in transverse cross section.

12. The apparatus of claim 8 wherein the end portions of said carrier are of circular cylindrical shape and alternating portions thereof between said end portions are elliptic cylindrical and circular cylindrical in shape.

13. The apparatus of claim 12 wherein each of said elliptic cylindrical portions of said carrier includes a recess disposed in the inner wall surface thereof positioned to intersect the long axis of the ellipse defined by the wall of said elliptic cylindrical portion when viewed in transverse cross section.

14. Apparatus for perforating a well which comprises:

a closed tubular carrier adapted to be lowered and raised through tubing disposed in a well bore, the end portions of said carrier being of circular cylindrical shape and at least one portion thereof between said end portions being elliptic cylindrical in shape;

a plurality of shaped charges disposed within said elliptic cylindrical portion of said carrier, the perforating axes of said shaped charges being positioned coincidentally with the long axis of the ellipse defined by the wall of said elliptic cylindrical portion when viewed in transverse cross section so that upon detonation of said shaped charges and penetration of said wall by the jets formed thereby, the ellipticity of said elliptic cylindrical portion of said carrier is reduced.

15. The apparatus of claim 14 wherein said carrier is further characterized to include a plurality of recesses disposed in the inner wall surface of said elliptic cylindrical portion thereof, each of said recesses being positioned to intersect the perforating axis of one of said shaped charges.

* * * * *